US005555834A

United States Patent [19]

Bonner

[11] Patent Number: 5,555,834

[45] Date of Patent: Sep. 17, 1996

[54] DOUBLE-NEEDLE CHUCK ASSEMBLY WITH MOVABLE KNIFE FOR SEWING MACHINE

[76] Inventor: Kevin B. Bonner, P.O. Box 339, Section, Ala. 35771

[21] Appl. No.: 869,946

[22] Filed: Apr. 17, 1992

[51] Int. Cl.[6] ..... D05B 37/04; D05B 3/06

[52] U.S. Cl. ..... 112/129; 112/68

[58] Field of Search ..... 112/129, 68, 264.1, 112/66, 226, 122.1, 125, 128, 122; 83/905, 698, 699, 700, 651, 697, 936, 613, 563, 564; 403/381, DIG. 6; 30/272.1, 275.4, 296.1, 320, 321, 330, 335, 337, 342

[56] References Cited

U.S. PATENT DOCUMENTS

| | | | |
|---|---|---|---|
| 660,617 | 10/1900 | Bissinger | 112/122.1 |
| 678,993 | 7/1901 | Bissinger | 112/128 X |
| 1,859,226 | 5/1932 | Vosbikian et al. | 30/335 X |
| 2,063,398 | 12/1936 | Pikul et al. | 83/700 X |
| 2,581,046 | 1/1952 | Rich | 112/68 |
| 2,620,759 | 12/1952 | Pantusco et al. | 112/68 |
| 3,361,098 | 1/1968 | Seaman | 112/68 X |
| 3,440,982 | 4/1969 | Seaman | 112/68 |
| 3,788,245 | 1/1974 | Bonner, Sr. | 83/700 X |
| 3,926,082 | 12/1975 | Von Langendorff | 83/700 X |
| 4,403,885 | 9/1983 | Babb | 403/381 X |
| 4,558,620 | 12/1985 | Wallis | 83/700 X |
| 5,018,347 | 5/1991 | Feilen | 30/335 X |
| 5,085,157 | 2/1992 | Jung et al. | 112/68 |

*Primary Examiner*—Paul C. Lewis
*Attorney, Agent, or Firm*—C. A. Phillips; Joseph H. Beumer

[57] ABSTRACT

A double-needle chuck assembly for a sewing machine is provided with a knife that is moveable from a position on one side of the needles to a position on the other side. This enables a closed slit, as might be required for a pocket of a garment, to be produced with stitching on both sides and at the ends thereof without reversing the direction of movement of the fabric or using a separate step in a production line. The knife is mounted on a rod which engages a slot extending between the needles, with the rod being securable in either of the two positions by a detent mechanism. Movement of the rod to change positions of the knife may be performed manually or by a pneumatic actuator.

8 Claims, 2 Drawing Sheets

DOUBLE-NEEDLE CHUCK ASSEMBLY WITH MOVABLE KNIFE FOR SEWING MACHINE

FIELD OF THE INVENTION

This invention relates to sewing machine equipment for providing a double row of stitching with a cut between the rows.

BACKGROUND OF THE INVENTION

One of the special requirements presented in sewing of fabrics into garments and other products is to provide suitable equipment for simultaneously cutting and stitching around closed-end slits for pocket openings and the like. In order to obtain necessary strength as well as a favorable appearance in such locations, the fabric should be stitched along the length of both sides of the slit and past both ends. Equipment for this purpose should include features for simultaneously performing both cutting and stitching in one operation and in all locations with a minimum requirement for manipulation of the fabrics or special equipment.

Prior devices for making stitched slits have used a double-needle chuck supporting a pair of spaced-apart needles arrange, to form a double row of stitches and a knife rigidly mounted in the chuck in fixed relation to the needles so as to cut a slit between the rows of stitches while stitching is in progress. The knife in these devices is normally mounted slightly to the front or rear of the needles and along a line halfway between them. For slits closed at both ends, this arrangement requires a two-step operation to complete the stitching and cutting operation. This is due to the requirement that the stitching should extend past the end of the slit at both ends. With the knife mounted in fixed relation and trailing the needles in the direction in which the fabric is being moved, proper end area stitching would be obtained at only one end because the knife would precede, rather than trail, the needles at the other end. To complete the stitching procedure, manipulation of the fabric as by lifting it and turning it around and/or passing it onto another machine would be required. An improved double-needle chuck assembly that would enable stitching beyond both ends of a closed slit in a single step is desired.

SUMMARY OF THE INVENTION

The present invention is directed to a double-needle chuck assembly for a sewing machine, the assembly including a housing block with a pair of needles and a knife supported by the block and arranged to produce a double row of stitching and a slit between the rows. The knife is mounted on the block so as to be movable back and forth from a first position on one side of line defined by the needles to a second position on the reverse side. This enables the knife to be located in trailing relation to the needles at both ends of a closed slit by moving the knife across the line between the needles after stitching at one end. The knife may be mounted for slidable movement between the needles from one side to the other by being affixed to a rod received in a slot in the housing, the rod being movable axially between the two desired positions for the knife. Movement of the rod is enabled by a knob at one end thereof, which may be engaged manually by an operator or remotely by a pneumatic actuator.

By providing for movement of the knife back and forth between the needles, any need to perform manipulations such as reversing the direction of movement of the fabric or to perform necessary stitching in a step that is separate from cutting in the production process is avoided. Labor requirements for making a given garment are thereby reduced.

It is therefore an object of this invention to provide a double-needle chuck assembly for a sewing machine in which a knife may be moved back and forth between a pair of needles.

Another object is to provide a double-needle sewing machine chuck assembly which enables a closed-end fabric slit to be stitched beyond both ends while being cut without reversing the direction of movement of the fabric.

Yet another object is to provide such an assembly in which the knife may be moved from one position to the other remotely.

Other objects and advantages of the invention will be apparent from the following detailed description and the appended claims.

DESCRIPTION OF THE PREFERRED EMBODIMENT

Figure 1:
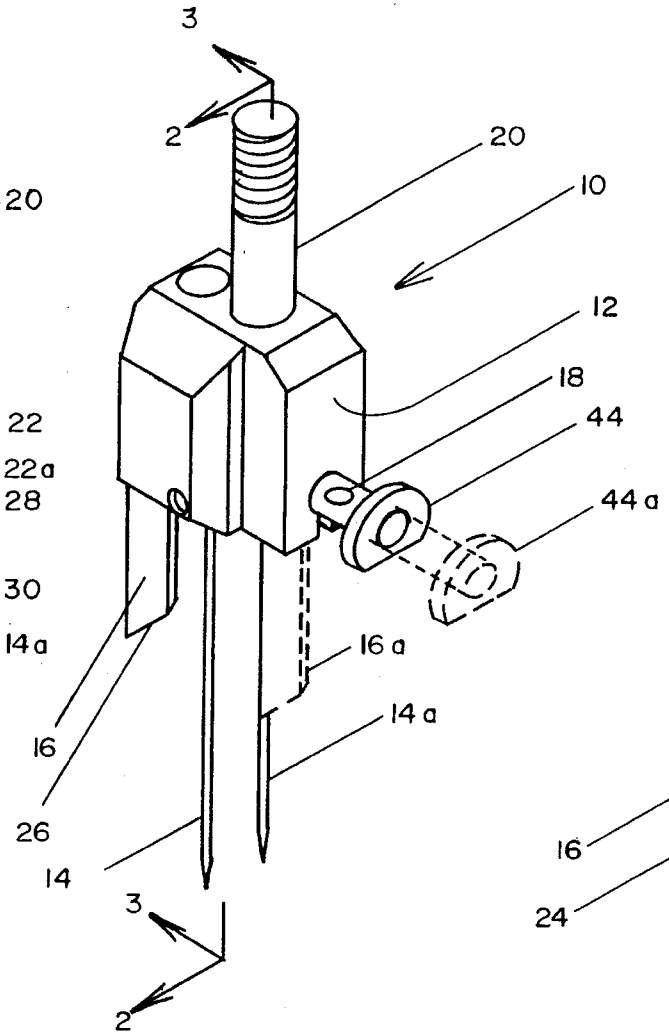
FIG. 1 is an isometric view showing a double-needle chuck assembly embodying the invention, with positions of certain part after movement being shown in dotted lines.

Referring to FIG. 1 of the drawings, there is shown a double-needle chuck assembly 10 embodying the invention. The assembly has a generally rectangular metal housing block 12 in which are mounted a pair of needles 14, **14*a*, a knife 16, and a knife-supporting rod 18. Shaft 20** extends upward from the top of the block and is threaded for connection to an arm (not shown) of a sewing machine disposed for reciprocating up and down motion to carry out stitching in a conventional manner.

Figure 2:
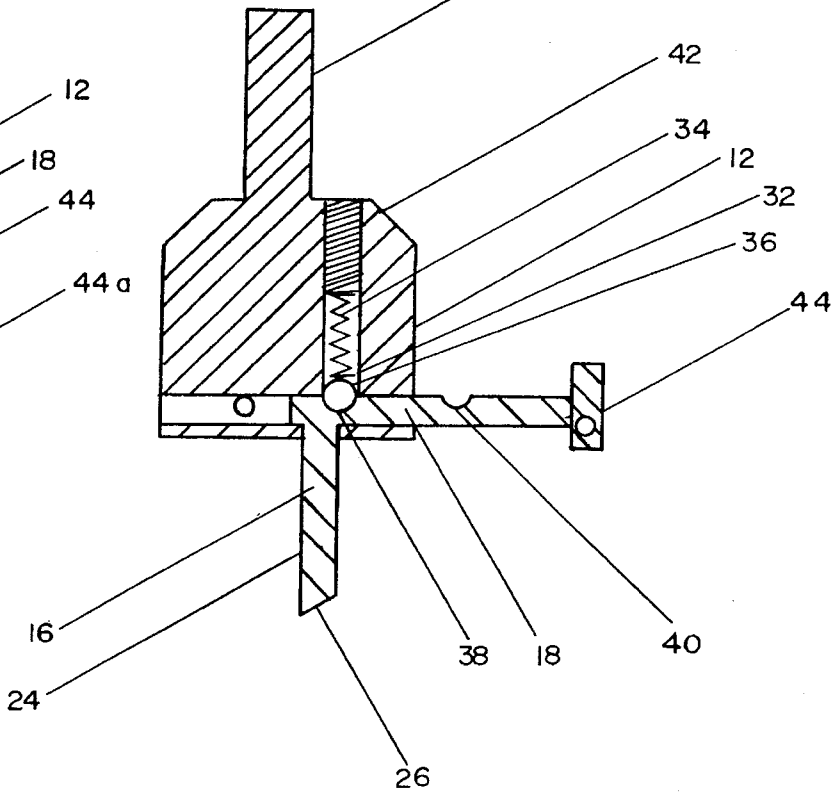
FIG. 2 is a sectional view taken along line 2—2 of FIG. 1.
Figure 3:
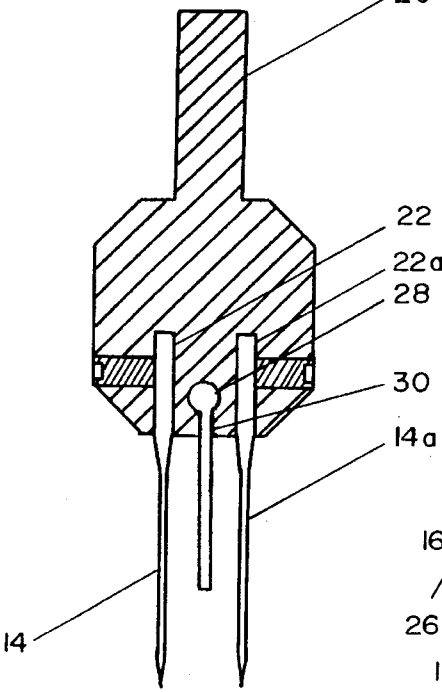
FIG. 3 is a sectional view taken along line 3—3 of FIG. 1.

Needles 14, **14*a* are fixedly mounted in holes 22, 22*a* (FIG. 3) in spaced-apart relation, aligned vertically and transverse to the housing block. The needles are thereby positioned normal to a plane along which a fabric piece is moved when being stitched. Knife 16 has a blade 24 aligned parallel to needles 14, 14*a*, with an inclined cutting edge 26 disposed to make a cut in a fabric piece intermediate to rows of stitching made by needles 14, 14*a* and extending in the same direction as the stitching. Knife 16 has its top edge fixedly secured to rod 18, perpendicular to the rod and disposed for being moved by the rod from a first position on one side of the needles as shown in solid lines in FIG. 1 to a second position (16*a* in dotted lines) on the opposite side. Rod 18 rides in a circular bore 28 extending through the housing block transverse to the line defined by the needles. Bore 28 is spaced upward slightly from the bottom of the housing and has an elongated slot 30 communicating the bore with the outside. This slot accommodates knife 16, allowing it to be slid axially upon pulling or pushing of the rod. As shown in FIG. 2, housing block includes an upwardly extending circular bore 32 in which is located a spring 34 downwardly biasing a ball 36 of a detent mechanism. The ball removably engages indentations 38, 40 in the top of the rod, removably securing the rod in place. Threaded screw 42 retains the spring and ball in position. Rod 18 at its outer end is provided with a knob 44** for grasping by an operator to move the rod back and forth to the two positions shown.

Figure 4:
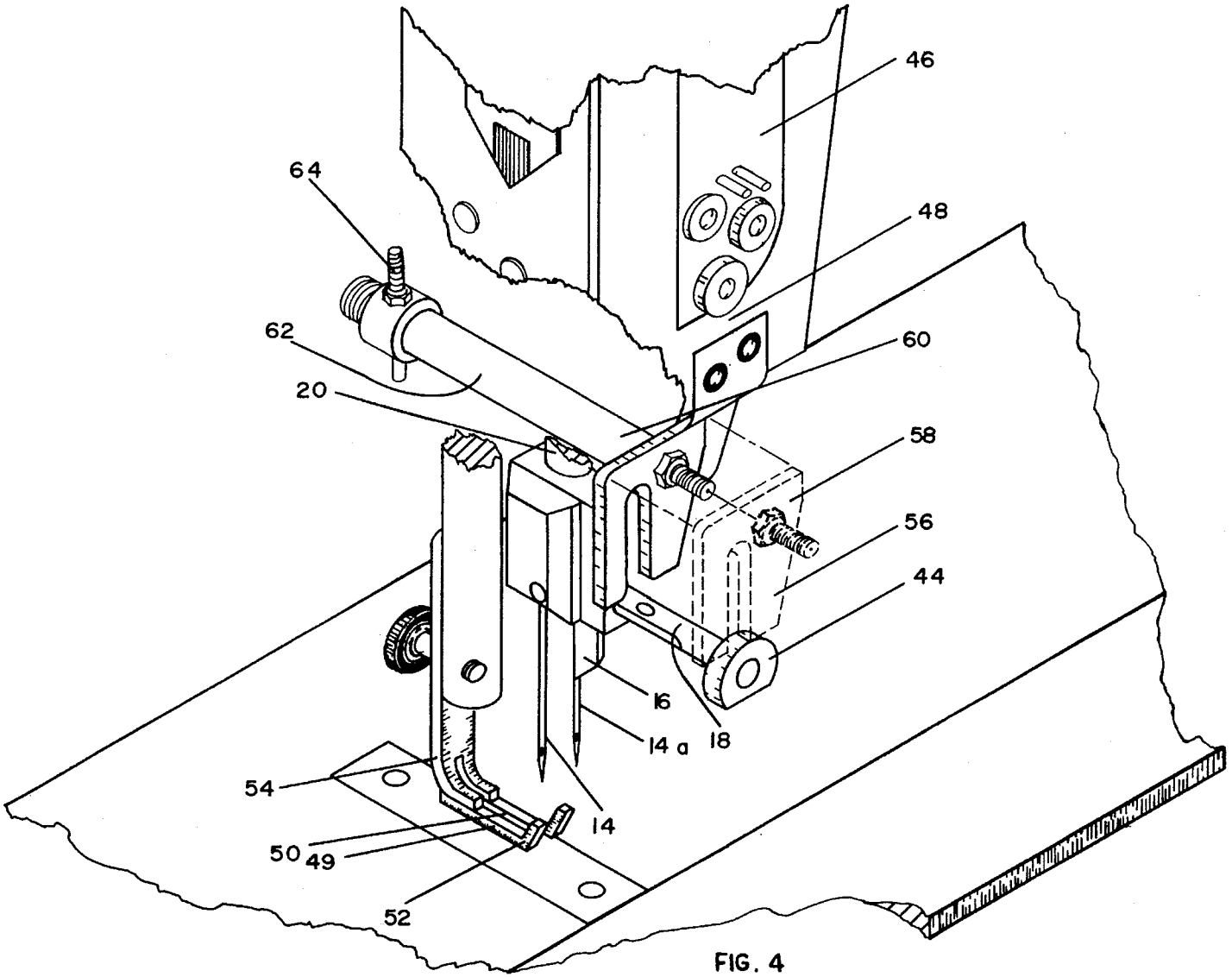
FIG. 4 is a pictorial view, partially broken away, showing the chuck assembly of the present invention installed-on a sewing machine.

FIG. 4 shows the chuck assembly in place on a sewing machine 46. Shaft 20 of the assembly is secured to be reciprocated by a mechanism (not shown) within head 48 of the machine, with needles 14, 14*a* aligned vertically and spaced apart in position over foot 49 so as to clear the foot on each side when stitching. The foot, which secures the fabric being stitched in position while being stitched, has a slot 50 in its bottom plate 52 and extending outward in the direction of stitching. This allows knife 16 to pass through and along the slot when being moved from one position to another. The foot is fixedly mounted to bracket 54, which in turn is secured to head 48.

Knife 16 in FIG. 4 is movable by sliding of rod 18 to the position shown by engagement of knob 44 with prongs 56 of plate of pneumatic actutaor 60. The actuator has a cylinder 62 in which a piston (not shown) is axially movable by compressed air provided through inlet 64. Remotely controlled movement of the rod in both directions may be obtained by fixedly securing the actuator plate to the knob and using a conventional, remotely controlled, double-acting pneumatic actuator.

Chuck assemblies embodying the invention may be modified as required to fit on a given sewing machine, and in some cases minor modifications to other components of the machine may be required. For example, provision of a foot that has a slot such as to acccommodate movement of the knife is required for effective operation. Bracket and other attachment means for securing pneumatic actuators may also be required.

It is to be understood that various other minor changes and modifications may be employed by one skilled in the art without departing from the spirit and scope of the invention, which is limited only as indicated by the appended claims.

I claim:

1. A double-needle chuck assembly for a sewing machine comprising:

a supporting block;

means for attaching said block to a vertically reciprocating member of a sewing machine;

a pair of needles for producing two rows of stitches in a workpiece to be sewn vertically mounted in said block in spaced apart, parallel relation and defining a line therebetween;

a knife supported by said block and positioned to make a closed end slit in said workpiece perpendicular to said line between said needles and intermediate to said two rows of stitches produced by said needles; and means associated with said block for moving said knife from a first operating position on one side of said line between said needles to a second operating position on the opposite side thereof comprising:

a track carried by said block and having an axis perpendicular to said line, a knife-supporting element slidably mounted for linear movement along said axis in said track, said knife being mounted in a fixed position on said element;

whereby said knife may be placed in trailing relation to said needles at each end of said closed end slit; and means carried by said block for removably securing said knife-supporting element in a first location along said axis whereby said knife is held in said first operating position and in a second location along said axis whereby said knife is held in said second operating position.

2. The chuck assembly as defined in claim 1 wherein said knife-supporting element comprises a generally cylindrical rod, and said knife is secured thereto so as to extend outward radially from the rod.

3. The chuck assembly as defined in claim 2 wherein said track comprises a generally cylindrical bore for engaging said rod and a slot below said bore for receiving said knife.

4. The chuck assembly as defined in claim 3 wherein said means for removably securing said rod in said first and second locations comprises spring-based retaining means.

5. The chuck assembly as defined in claim 4 wherein said retaining means comprises a ball, a spring disposed vertically in a bore in said housing and biasing said ball downward, and a pair of indentations in said rod receiving said ball when said knife is placed in said first and second positions.

6. The chuck assembly as defined in claim 5 including a knob secured to an end of said rod.

7. The chuck assembly as defined in claim 6 including a pneumatic actuator connected to said machine for engaging said knob for imparting axial movement to said rod.

8. The chuck assembly as defined in claim 6 including actuator means connected to said machine for engaging said knob and thereby imparting axial movement to said rod.

* * * * *